US009803269B2

(12) United States Patent
Matsumoto et al.

(10) Patent No.: US 9,803,269 B2
(45) Date of Patent: Oct. 31, 2017

(54) α+β TYPE TITANIUM ALLOY AND PRODUCTION METHOD THEREFOR

(71) Applicants: NHK Spring Co., Ltd., Yokohama-shi, Kanagawa (JP); Tohoku University, Sendai-shi, Miyagi (JP)

(72) Inventors: Hiroaki Matsumoto, Sendai (JP); Akihiko Chiba, Sendai (JP); Sang-Hak Lee, Yokohama (JP); Yoshiki Ono, Yokohama (JP)

(73) Assignees: NHK SPRING CO., LTD., Kanagawa (JP); TOHOKU UNIVERSITY, Miyagi (JP)

( * ) Notice: Subject to any disclaimer, the term of this patent is extended or adjusted under 35 U.S.C. 154(b) by 435 days.

(21) Appl. No.: 14/412,567

(22) PCT Filed: Jun. 28, 2013

(86) PCT No.: PCT/JP2013/068453
§ 371 (c)(1),
(2) Date: Jan. 2, 2015

(87) PCT Pub. No.: WO2014/007359
PCT Pub. Date: Jan. 9, 2014

(65) Prior Publication Data

US 2015/0159252 A1 Jun. 11, 2015

(30) Foreign Application Priority Data

Jul. 2, 2012 (JP) ..... 2012-148408

(51) Int. Cl.
*C22F 1/18* (2006.01)
*C22C 14/00* (2006.01)
*C22F 1/00* (2006.01)

(52) U.S. Cl.
CPC ..... *C22F 1/183* (2013.01); *C22C 14/00* (2013.01); *C22F 1/00* (2013.01)

(58) Field of Classification Search
CPC ..... C22F 1/183; C22C 14/00
See application file for complete search history.

(56) References Cited

U.S. PATENT DOCUMENTS

2012/0168042 A1 7/2012 Lee et al.
2013/0284325 A1 10/2013 Lee et al.

FOREIGN PATENT DOCUMENTS

JP H03-274238 A 12/1991
WO 2011/037127 A2 3/2011
WO 2012/070685 A1 5/2012

OTHER PUBLICATIONS

Jan. 27, 2016 Office Action issued in Chinese Patent Application No. 201380035253.6.

(Continued)

*Primary Examiner* — Jessee Roe
(74) *Attorney, Agent, or Firm* — Oliff PLC

(57) ABSTRACT

The present invention provides an α+β type titanium alloy and a production method therefor, which has an ultrafine structure causing superplasticity under low temperatures and has a high deformation ratio compared to conventional α+β type Ti alloys. The alloy has an ultrafine structure made of equiaxial crystals in which an area ratio of crystals having a grain diameter of 1 μm or less is 60% or more, and maximum frequency grain diameter is 0.5 μm or less, wherein a portion in which the integration degree of plane orientation of the hexagonal close-packed crystal is 1.00 or more exists within a range of 0 to 60 degrees with respect to a normal line of a processed surface of the alloy.

7 Claims, 6 Drawing Sheets

(56) References Cited

OTHER PUBLICATIONS

Matsumoto, Hiroaki et al., "Formation of Ultrafine-Grained Microstructure of Ti-6Al-4V Alloy by Hot Deformation of a+ Martensite Starting Microstructure", Advanced Engineering Materials, 2011, vol. 13, No. 6, pp. 470-474.
Mar. 8, 2016 Extended Search Report issued in European Patent Application No. 13812689.1.
G.A. Salishchev et al., "Development of Ti-6Al-4V sheet with low temperature superplastic properties," Journal of Materials Processing Technology 2001, vol. 116, pp. 265-268.
J.A. Wert et al., "Enhanced Superplasticity and Strength in Modified Ti-6Al-4V Alloys," Metallurgical Transactions,1983, vol. 14A, No. 12, pp. 2535-2544.
G.A. Salishchev et al., "Development of Ti-6Al-4V sheet with low temperature superplastic properties," Journal of Materials Processing Technology 2011, vol. 116, pp. 265-268.
R.S. Mishra et al., "Mechanical behavior and superplasticity of a severe plastic deformation processed nanocrystalline Ti-6Al-4V alloy," Materials Science and Engineering A, 2001, vol. 298, Nos. 1-2, pp. 44-50.
G.A. Salishchev et al., "Formation of submicrocrystalline structure in the titanium alloy VT8 and its influence on mechanical properties," Journal of Materials Science, 1993, vol. 28, No. 11, pp. 2898-2902.
G.A. Salishchev et al., "Low Temperature Superplasticity of Submicrocrystalline Titanium Alloys," Superplasticity in Advanced Materials ICSAM-97, Materials Science Forum, 1997, vols. 243-245, pp. 585-590.
Y.G. Ko et al., "Microstructural influence on low-temperature superplasticity of ultrafine-grained Ti-6Al-4V alloy," Materials Science and Engineering A, 2005, vols. 410-411, pp. 156-159.
Nobuhiro Tsuji, "Formation Mechanisms of Ultrafine Grained Structures in Severe Plastic Deformation of Metallic Materials," Tetsu-to-Hagane, 2008, vol. 94 No. 12, pp. 582-589.
A.V. Sergueeva et al., "Enhanced Superplasticity in a Ti-6Al-AV Alloy Processed by Severe Plastic Deformation," Scripta Materialia, 2000, vol. 43, No. 9 , pp. 819-824.
H.-J. Bunge, Texture Analysis in Materials Science, Butterworths, (England), 1982.
Y.G. Ko et al., Low-Temperature Superplasticity of Ultra-Fine-Grained Ti-6Al-4V Processed by Equal-Channel Angular Pressing, Metallurgical and Materials Transactions A, 2006, vol. 37A, pp. 381-391.
L.D. Hefti, "Fine-Grain Titanium 6Al-4V for Superplastic Forming and Diffusion Bonding of Aerospace Products," JOM, 2010, vol. 62, No. 5, pp. 42-45.
Aug. 6, 2013 International Search Report issued in Application No. PCT/JP2013/068453.

α+β TYPE TITANIUM ALLOY AND PRODUCTION METHOD THEREFOR

TECHNICAL FIELD

The present invention relates to an α+β type titanium alloy and to a production method therefor that can be widely applied to transferring apparatuses, chemical plants, energy producing plants, general consumer products, and in particular, relates to an α+β type titanium alloy having an ultrafine structure that causes superplasticity at lower temperatures at higher deformation rates than conventional α+β type titanium alloys, and to a production method therefor.

BACKGROUND ART

Ti alloys have high specific strength and superior corrosion resistance and are widely used in various fields such as in the field of aviation and the field of chemical plants. In this forming, use of a superplasticity (hereinafter referred to "superplastic forming") is particulary effective. The superplasticity is also applied in joining processing, and in particular, the combined processing of superplastic forming and diffusion bonding (SPF/DB) is practically applied in the field of aviation.

In conventional Ti-6Al-4V alloys, in order to cause the superplasticity, forming is performed at a high temperature of about 800 to 950° C. and in a condition of plastic deformation at a low strain ratio of $1\times10^{-4}$ to $10^{-3}$/sec. However, since the forming is performed at high temperature at a low deformation rate, the production efficiency is low and deterioration of mechanical properties easily occurs due to oxidization of the material and coarsening of crystal grains in the superplastic forming. Furthermore, there is a problem in that the service life of a die is short since forming is performed at a high temperature. The superplastic forming of Ti-6Al-4V alloys is an attractive process which enables near-net shape forming. However, the superplastic forming with conventional Ti-6Al-4V alloys has various problems as mentioned above, and the applicable range is limited. Therefore, it is strongly desired for Ti alloys to cause the superplasticity at a low temperature at a high deforming rate.

Until now, it has been reported in "METALLURGICAL TRANSACTIONS" (J. A. Wert and N. E. Paton, 1983, A14, p. 2535-2544) that the superplastic forming temperature can be reduced by alloy design in which the ratios of the amounts of an α phase and a β phase are adjusted. In JP3-274238, a Ti-4.5Al-3V-2Mo-2Fe alloy in which the superplastic forming temperature can be at least 100° C. lower than that of Ti-6Al-4V alloy by suitable alloy design, was developed. On the other hand, as a method for causing the superplasticity at a low temperature at a high deforming rate, refinement of crystal grains may be exemplified. For example, it has been reported that an ultrafine structure of average grain size of 0.5 μm or less is formed by utilizing severe plastic deformation processing in a Ti-6Al-4V alloy, can lower the superplastic forming temperature by 150 to 250° C. than the conventional structure, and can cause the superplasticity at high forming rates (strain rates) of $1\times10^{-3}$ to $10^{-2}$/sec ("Journal of Materials Processing Technology" (G. A. Salishchev et al., 2001, 116, pp. 265-268), "Materials Science and Engineering" (R. S. Mishra et al., 2001, A298, pp. 44-50), "JOURNAL OF MATERIALS SCIENCE" (G. A. Salishchev, O. R. Valiakhmetov, R. M. Galley, 1993, 28, pp. 2898-2902), "Materials Science Forum" (G. A. Salishchev, O. R. Galeyev, S. P. Malysheva, O. R. Valiakhmetov in ICSAM'97 (Ed. A. H. ChokShi), 1997, 243-245, pp. 585-591), "Materials Science and Engineering" (Y. G. Ko et Al., 2005, A 410-411, pp. 156-159), "Formation of fine grain structure following to super severe deformation" (Nobuhiro TSUJI, Iron and Steel, 2008, 94, pp. 582-589)). Lowering temperature and increasing deforming rate in the superplastic forming results not only in efficient production, but also prevents oxidization of material, inhibits deterioration of mechanical properties, prolongs the service life of dies, and decreases the total forming cost.

However, the severe deformation process is a method in which an amount of strain of 4 to 5 is introduced in the material and performed by methods such as ECAP (Equal Channel Angular Pressing) method, HPT (High Pressure Torsion) method, MM (Mechanical Milling) method, ARB (Accumulative Roll-Bonding) method, multi-axis forging method, and high speed shot peening method. Such severe deforming processes require introduction of a large amount of strain, and this is not suitable for production of large material for forming and mass production. For example, a Ti-6Al-4V alloy which was formed (strain amount, $\epsilon$=8) by the ECAP method (reported in "Materials Science and Engineering") and a Ti-6Al-4V alloy which was formed (strain amount, c=7) by the HPT method (reported in "Scripta MATERIALIA" (A. V. Sergueeva et al., 2000, 43, pp. 819-824) exhibit superplasticity at temperatures of 650° C. and 700° C. However, the strain amount introduced in the materials is identical to deformation in which a ingot 450 to 1000 mm thick is rolled to 1 mm thick at one time rapidly, whereby, this is not realistic in a production process of a plate using a simple rolling process. It should be noted that most of the practical materials for superplastic forming are provided as plate materials, primarily as airplane structural parts. Therefore, it has been strongly desired to provide techniques for practical superplastic forming processes in α+β type Ti alloys, which are easy to obtain by relatively low-cost and are widely used.

Refinement of crystal grains of Ti alloys contributes not only to improvement of superplasticity, but also yields great improvement in mechanical properties such as strength and fatigue properties. Therefore, refinement of crystal grains is effective as a method for improving several material properties together.

SUMMARY OF THE INVENTION

Therefore, it is desired to provide a simple method in which a Ti alloy that causes a superplasticity in a condition of low superplastic forming temperatures and high plastic forming rate (strain rate) can be produced. That is, an object of the present invention is to provide an α+β type Ti alloy, which has an ultrafine structure causing superplasticity at a low temperature in a high deformation rate compared to the conventional α+β type Ti alloy and is produced at approximately the same cost as the conventional cost for producing plate materials without using the conventional severe deformation process, and to provide a production method therefor.

The subject matter of the present invention is to form an ultrafine structure by one processing without using the severe deforming method, such as the ECAP method, by utilizing an ultrafine structure forming technique in which an α' martensite structure of an α+β type Ti alloy (for example, Ti-6Al-4V alloy, and the like) as a starting material, is subjected to hot working under suitable processing conditions. Then, the formation of an ultrafine structure allows obtaining a Ti alloy causing superplasticity at a low temperature at a high deformation rate.

The inventors have researched the production of inexpensive Ti alloy compositions, not β type Ti alloy compositions, which are classified as near-α type or α+β type having a low β phase ratio at room temperature by ordinary cooling after solution treatment. As a result, they found a Ti alloy of the present invention that causes superplasticity at low temperatures at high deformation rates by making a nanoscale fine equiaxial crystal structure from conventional structures on the order of micrometers. To obtain such a Ti alloy, in the present invention, an ultrafine structure is formed by performing hot working even with small amount of the strain, in which an α' martensite phase is used as a processing starting structure, which has not been conventionally used.

The production method according to the present invention is very simple compared to the conventional severe deformation method, wherein a processing starting material is an α' martensite structure, in which dynamic recrystallization is developed in hot working, thereby obtaining an ultrafine structure in a region which is deformed at a processing rate (strain rate) of 1 to 50/sec in strain of 1 or more. That is, the Ti alloy comprising an ultrafine structure consisting of equiaxial crystals in which an area ratio of crystals having a grain diameter of 1 μm or less is 60% or more, and maximum frequency grain diameter is 0.5 μm or less, wherein a portion in which a integration degree of plane orientation (0001) of the hexagonal close-packed (herein after referred as "hcp") crystal is 1.00 or more exists within a range of 0 to 60 degrees with respect to a normal line of a processed surface of the alloy. Although the reason such a structure exhibits superplasticity characteristics at a low temperature at a high deformation rate, that is the object of the present invention, is not clear, the reason it may be supposed that when superplastic forming is performed at a temperature not greater than the β transus temperature, the superplastic phenomenon is caused by the grain boundary sliding of fine a grains and the crystal slip planes are extensively oriented since the integration degree of orientation is high. Furthermore, since the above ultrafine structure is mostly constructed by α phase and hardly includes a β phase, a solid solution from the β phase to the α phase which interferes with plastic deformation, does not occur. Conversely, there is slightly extremely small amount transformation from the α phase to the β phase at an α grain boundary according to the equilibrium phase diagram when the processing temperature is in a range of 650 to 950° C., thereby promoting sliding between a grains. The present invention has been completed by research based on the above assumptions.

The reason the processing starting material in the α+β type Ti alloy of the present invention has a structure of an α' martensite phase is described hereinafter. The α' martensite phase is generated by quenching the Ti alloy after solution treatment, and this is a crystal phase which is formed in a non-diffusion transformation during a solution quenching process from a temperature higher than the β transus, and this does not occur in a β type Ti alloy in which a β phase remains at room temperature as it is. The α' martensite crystals are acicular, and the crystal structure is the hcp crystal structure similar to an equilibrium α crystal; however, unlike the equilibrium α crystal, by rapid cooling, it enters a thermally unstable crystal phase and it has a crystal phase structure having a large number of defective (α' (10-11) twin crystals, stacking faults or dislocations on α' (0001), or the like) in the acicular crystal structure. It should be noted that "−1" means 1 having a bar (−) above the "1". This is similar also in the explanation hereinafter. Therefore, the inventors thought that since an amassed part of such stacking faults or dislocations would be energetically unstable and easily act as generation sites of a nucleus of a recrystallization, there would be numerous places that are nucleus generating sites compared to the α+β phase structure conventionally used for processing, and by performing hot working using this α' structure as a starting structure, uniform and fine nanoscale equiaxial crystals may be produced easily and widely.

The processing which occurs dynamic recrystallization is specifically processing at a processing rate (strain rate) of 1 to 50/sec in strain of 1 or more.

That is, the production method of α+β type titanium alloy of the present invention comprises heating a material at a temperature of 1000° C. or more and maintaining for 1 second or more, cooling the material to room temperature at a cooling rate of 20° C./sec or more, heating the material to a temperature of 700 to 850° C. at a temperature increase rate of 3.5 to 800° C./sec and maintaining for less than 10 minutes, hot working the material at a processing rate (strain rate) of 1 to 50/sec with a strain of 1 or more, and cooling the material at a cooling rate of 5 to 400° C./sec.

The Ti alloy produced by the above method has a composition that is generally classified as a titanium alloy of at least one of the near-α type and the α+β type, and comprises an ultrafine structure consisting of equiaxial crystals in which an area ratio of crystals having a grain diameter of 1 μm or less is 60% or more, and maximum frequency grain diameter is 0.5 μm or less, wherein a portion in which an integration degree of plane orientation (0001) of the hcp crystal is 1.00 or more exists within a range of 0 to 60 degrees with respect to a normal line of a processed surface of the alloy. It should be noted that since the lower limit of crystal grain diameter that can be observed by SEM/EBSD method of acceleration voltage 20 kV at 50000 magnification is 98 nm, the minimum value of the crystal grain diameter in the present invention is substantially 98 nm. Here, α+β type Ti alloy is a Ti alloy having 10 to 50% of area ratio of the β phase at room temperature, depending on the cooling rate of ordinary casting or the like, and near-α type Ti alloy is a Ti alloy containing 1 to 2 mass % of the β phase stabilizing element such as V, Cr, Mo or the like and having above 0% to 10% of area ratio of β phase at room temperature depending on the cooling rate. However, in the present invention in which a material which is rapidly cooled and made so as to be an α' martensite structure in nearly its entirety (level at which the β phase cannot be detected by an X-ray diffraction method) is used as a starting material and then is hot worked, it is desirable that the area ratio of the β phase be not more than 1.0%. The reason for this is that if the area ratio of the (3 phase is more than 1.0%, the fine structure such as above cannot be formed and superplastic characteristics, which is the object of the present invention, are not exhibited at a low temperature at a high deformation rate. It should be noted that a case in which the β phase is more than 50 area % at room temperature and martensite transformation does not occur corresponds to a β type alloy.

As is understood from the grain boundary map by the EBSD method, the above crystal is an ultrafine structure consisting of equiaxial crystals, wherein a portion in which an integration degree of plane orientation (0001) of the hcp crystal is 1.00 or more exists within a range of 0 to 60 degrees with respect to a normal line of a processed surface. The integration degree of specific crystal orientation indicates a multiplying factor of existence frequency of crystal grains having the specific orientation in a structure with respect to a structure having completely random distribution of crystal orientation (all orientation exist with the same probability, it defines the integration degree is 1). This integration degree can be obtained by using the texture analysis of the inverse pole figure (development index=16, Gauss half bandwidth=5) using the generalized spherical harmonic expansion: GSHE (refer to "Texture Analysis In Materials Science. Butterworths" H. J. Bunge, (England), 1982) of the electron backscatter diffraction (EBSD) method. Since crystals having specific orientation congregate and exist at high frequency in a specific range of angle, sliding easily occur in super plastic forming conditions.

The reason for specifying structure and producing method in the α+β type Ti alloy of the present invention is explained hereinafter.

As the Ti alloy composition for forming a α' martensite structure which is the starting structure for processing in the present invention, a composition ordinarily classified as near-α type or α+β type titanium alloy is suitable. For example, in a case in which a composition ordinarily classified as an α type Ti alloy is rapidly cooled from not less than a β transus temperature in order to generate an α' martensite in the entirety, it becomes inefficient from the viewpoint of heating energy since the β transus temperature of α type Ti alloys is higher than that of near-α type or α+β type titanium alloys, and since a brittle $\alpha_2$ phase ($Ti_3Al$ for example) is generated in a certain temperature region, and as a result, the α' martensite structure cannot be obtained in the entirety. In addition, since near-β type and β type Ti alloys maintain a β phase metastably at room temperature, even if the rapid cooling is performed, an α' martensite phase structure cannot be obtained in almost the entirety to the level that cannot detect a β phase with the precision of the X-ray diffraction or the EBSD analysis either, and it will be confirmed that the β phase remains. Therefore, it cannot be expected to obtain uniform and fine dynamic recrystallization structures by using α' martensite. On the other hand, in a composition ordinarily classified as near-α type and α+β type Ti alloy after the rapid cooling, the β phase is nearly undetectable at a same as above analysis level. Therefore, compositions classified as near-α type and α+β type Ti alloy are better.

The reason for using an α' martensite phase as the starting structure for processing is that since it is a thermally unstable phase and contains large numbers of defects in the acicular structure, the defects easily act as generation sites for recrystallization nuclei. In addition, the dislocation of α<11-20>, which is an a-axis direction mainly moves in the acicular crystal α+β mixture structure, and on the other hand, in an α' martensite, deformation ability is greater than in an α structure since the dislocation of a c-axis direction also moves actively in addition to the a-axis direction, and furthermore, the direction and the number of dislocation intersecting spots of the acicular crystal structure is increased compared to an α+β mixture structure. This intersecting spot acts as a nucleus generation site, that is, this means that many more nucleus generation sites exist in the starting structure compared to an α+β phase by hot working. Therefore, it is advantageous to use an α' martensite phase as the starting structure for hot working.

Next, a basis for the above numerical limitations is explained. The numerical limitations of the present invention were obtained as a result of consideration of the basis that heating is performed in a short time (to prevent the coarse precipitation of the equilibrium phase) in order not to use the energy (heat and time) for the starting structure generating crystal grain coarsening or transformation to the equilibrium α+β phase, and that rapid cooling is performed (control growing of the recrystallization) after hot working (making of many recrystallization nucleus generation sites and the recrystal orientation).

In order to form an α' martensite structure as a starting structure for hot working, an α+β type Ti alloy such as a Ti-6Al-4V alloy is subjected to solid solution treatment. The solid solution treatment is performed such that the alloy is heated to a temperature of 1000° C. or more and maintained for 1 second or more, then is quenched to room temperature at a cooling rate of 20° C./sec or more. If the heating temperature is less than 1000° C., α' martensite cannot be obtained. If maintaining time is less than 1 second, solid solution treatment is insufficient. If the cooling rate is less than 20° C./sec, the equilibrium phase increases and crystal grains coarsen.

Temperature increase rate: 3.5 to 800° C./sec

Since an α' martensite phase, which is the starting structure, is a thermally unstable phase, it may give time for phase transformation to an equilibrium α+β phase, if the temperature increase rate is less than 3.5° C./sec. On the other hand, in the case in which the temperature increase rate is greater than 800° C./sec, although this depends on the size of the processed material, it becomes difficult to control temperature in a set of processes or realistic heating means, and it also becomes difficult to obtain the formed structure of the present invention over a wide region since temperature differences between the surface and the inside become too great. Furthermore, if the temperature increase rate is more than 800° C./sec, differences in flowability between the surface and the inside becomes great, and cracking may easily occur during processing. Therefore, the temperature increase rate is 3.5 to 800° C./sec.

Hot working temperature: 700 to 850° C., maintaining time before processing: less than 10 minutes, processing rate (strain rate): 1 to 50/sec, strain: 1 or more The above hot working conditions are conditions in which dynamic recrystallization of Ti alloy occurs actively, and in which uniform and fine crystal structure can be obtained when the α' martensite phase is used as the starting structure for processing. By hot working in these conditions, an alloy comprising an ultrafine structure consisting of equiaxial crystals in which an area ratio of crystals having grain diameter of 1 μm or less is 60% or more, and maximum frequency grain diameter is 0.5 μm or less, wherein a portion in which integration degree of plane orientation (0001) of the hcp crystal is 1.00 or more exists within a range of 0 to 60 degrees with respect to a normal line of a processed surface, can be obtained.

At a processing temperature of less than 700° C., driving energy for dynamic recrystallization decreases as temperature decreases, and there may be a decreased dynamic recrystallization region at a processed part, and it may not be uniform, and as a result, there may be a mixture of structures of coarse α crystals elongated by processing and nanocrystal structures of nonuniform dynamic recrystallization, in the entirety of the structure. Alternatively, there may be a case in which dynamic recrystallization does not occur and a nanocrystal structure is not generated. On the other hand, if the processing temperature is greater than 850° C., generation of a β phase and growing rate may be radically increased, and an equilibrium β phase may coarsen. Subsequently, a coarse α phase and an acicular structure may remain when cooled to room temperature.

Next, in the case in which a processing rate (strain rate) is less than 1/sec, considering practical operation, production efficiency may be decreased. On the other hand, in the case in which a processing rate is greater than 50/sec, it may not be practical from the viewpoint of radical increase of deformation resistance by rapid processing rate, cracking of processed material thereby, and too great a load on a processing apparatus. If the maintaining time before working is 10 minutes or more, the crystal grains easily coarsen.

In order to obtain the ultrafine structure consisting of equiaxial crystals in which an area ratio of crystals having a grain diameter of 1 μm or less is 60% or more, and a maximum frequency grain diameter is 0.5 μm or less, wherein a portion in which integration degree of plane orientation (0001) of the hcp crystal is 1.00 or more exists within a range of 0 to 60 degrees with respect to a normal line of a processed surface of the alloy, the strain obtained by processing must be 1 or more. In the present invention, superplastic deformation can be caused when the strain is 1.0, and considering production cost, a strain of 2 or less is sufficient. There is no need to form the above structure in the entirety of the material. According to the way the product will be used, the processing condition of the present invention may be applied to only a required portion such as a surface side in which operation stress is high, and the above structure may be formed in the processed portion at the area ratio of the present invention.

The value of the strain is decided by confirming that in a deformation resistance curve in hot working at a temperature of 700 to 850° C., deformation resistance is maximum in initial strain, then decreases to less than 1 (work-softening), then deformation resistance is constant when the strain is 1 or more because of approximate accomplishment of dynamic recrystallization.

It should be noted that strain in the present invention can be described by "e" in the following formula, and that "l" means distance between mark points of processing direction after processing and "$l_a$" means distance between mark points of processing direction before processing in the formula.

$$e=|\ln l/l_0|$$

Cooling rate after processing: 5 to 400° C./sec

After hot working, it is desirable that cooling be performed at a cooling rate not less than 5° C./sec in order not to coarsen nanocrystal grains generated by dynamic recrystallization. The upper limit of the cooling rate is 400° C./sec, which is realistic in practical use.

The hot working of the present invention may be applied to various types of plastic working such as rolling, drawing processing, swaging processing, and forging processing.

The α+β type Ti alloy of the present invention which was produced by the above production method, comprises an ultrafine structure consisting of equiaxial crystals in which an area ratio of crystals having a grain diameter of 1 μm or less is 60% or more, and maximum frequency grain diameter is 0.5 μm or less, wherein a portion in which integration degree of plane orientation (0001) of the hcp crystal is 1.00 or more exists within a range of 0 to 60 degrees with respect to a normal line of a processed surface of the alloy.

According to the α+β type Ti alloy of the present invention, since it has an ultrafine structure such as above, it causes a superplasticity at a temperature of 650 to 950° C. in a tensile strain rate of $1\times10^{-4}$ to $1\times10^{-2}$. It should be noted that the superplasticity is a phenomenon in which strain rate sensitivity index m of deforming stress is 0.3 or more and plastic elongation is 200% or more based on the general definition. The strain rate sensitivity index m is identical to an inclination of a logarithmically presented strain rate-stress curve, wherein m is merely 0.1 to 0.2 in ordinary plastic deformation, but is as large as $1>m\geq0.3$ in a region in which superplasticity appears.

The α+β type Ti alloy of the present invention may be Ti-8Mn, Ti-3Al-2.5V, Ti-6Al-6V-2Sn, Ti-7Al-1Mo, Ti-6Al-2Sn-4Zr-6Mo, Ti-5Al-2Cr-1Fe, or Ti-6Al-2Sn-4Zr-2Mo. The α+β type Ti alloy of the present invention is preferably a Ti-6Al-4V alloy which is widely used for popular use, the composition is preferably 4 to 9 mass % of Al, 2 to 10 mass % of V, balance Ti and inevitable impurities.

According to the present invention, an α+β type Ti alloy, which has an ultrafine structure causing superplasticity at a low temperature in a high deformation rate compared to the conventional α+β type Ti alloys, can be obtained at approximately the same cost as the conventional cost for producing plate materials without using the conventional severe deformation process, and a production method therefor can be obtained.

EXAMPLES

1. Structure

A plate with 4 mm thick Ti-6Al-4V alloy was prepared and subjected to solid solution treatment at 1100° C. for 30 minutes, and was quenched in water at a cooling rate of 20° C./sec or more, thereby forming an acicular α' martensite structure. Then, the plate was placed into a furnace and was heated at a temperature increase rate of 3.5 to 800° C./sec. When the temperature of the plate reached 700 to 850° C., the plate was immediately removed from the furnace and was subjected to hot rolling in one pass so that the thickness of the plate was 1.4 mm or less (condition in which applied strain was 1 or more). The peripheral velocity of the roll was set so that the strain rate at exit from the roll was 1 to 50/sec. The plate was cooled at a cooling rate of 5 to 400° C./sec after rolling.

Figure 1:
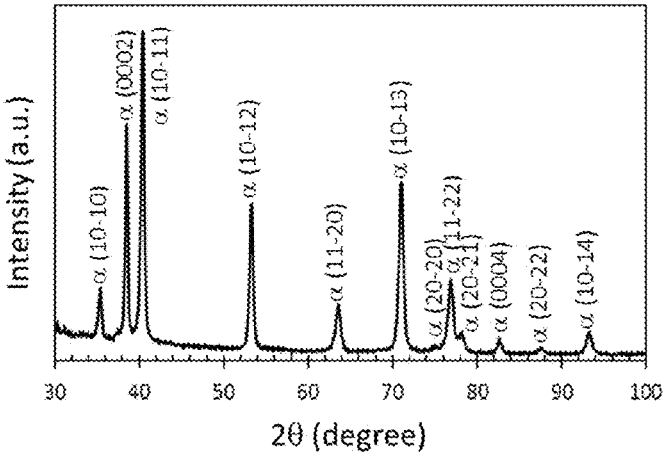
FIG. 1 shows a profile of X-ray diffraction of a material of the present invention.

The cross section of the plate was analyzed using an X-ray diffraction (XRD) apparatus. An example of the XRD profile is shown in FIG. 1. FIG. 1 is an XRD profile of Practical Example 1, which was processed at a processing temperature of 800° C., processing strain of 1.05, and a processing strain rate of 7/sec. It can be understood that the phase was almost a single α phase from FIG. 1.

Figure 2A:
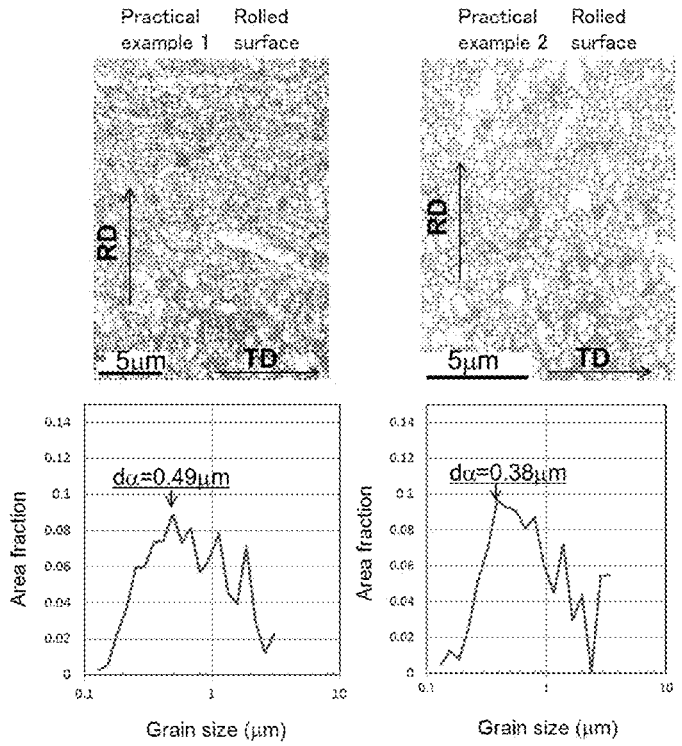
FIG. 2A shows structures of practical examples of the present invention and graphs showing crystal grain diameter distributions, which were measured by the electron backscatter diffraction (EBSD) method.

Then, the structural form was observed by an electron backscatter diffraction (EBSD) device (OIM ver. 4.6 produced by TSL Solutions). Specifically, a grain boundary map was made, and crystal grain diameter distribution of the α phase, which was the main structure, was measured. A typical example of the structural form of the plate after processing is shown in FIG. 2A. In FIG. 2A, Practical Example 2 was processed at a processing temperature of 800° C., processing strain of 1.05, and a processing strain rate of 7/sec. In FIG. 2A, the upper row shows grain boundary maps obtained by the EBSD method, showing structures of the rolled surfaces (processed surfaces) of Practical Examples 1 and 2, and the lower row shows graphs showing distributions of the crystal diameter of the α phase corresponding to the structures of Practical Examples 1 and 2. It should be noted that "RD" indicates the rolling direction and "TD" indicates cross direction in the grain boundary maps.

According to the grain boundary maps shown in FIG. 2A, although some amount of forms in which crystal grains elongate toward the rolling direction exist, it was understood that a large amount of the forms are occupied by fine equiaxial crystals. According to the graphs shown in FIG. 2A, it was found that a peak of maximum frequency of grain diameters appeared at 0.5 μm or less, respectively, and the area ratio of crystals in which the grain diameter was 1 μm or less is 60% or more. These results show that an ultrafine structure consisting of equiaxial crystals in which area ratio of crystals having a grain diameter of 1 μm or less was 60% or more, and maximum frequency grain diameter was 0.5 μm or less was formed by the hot rolling.

Figure 2B:
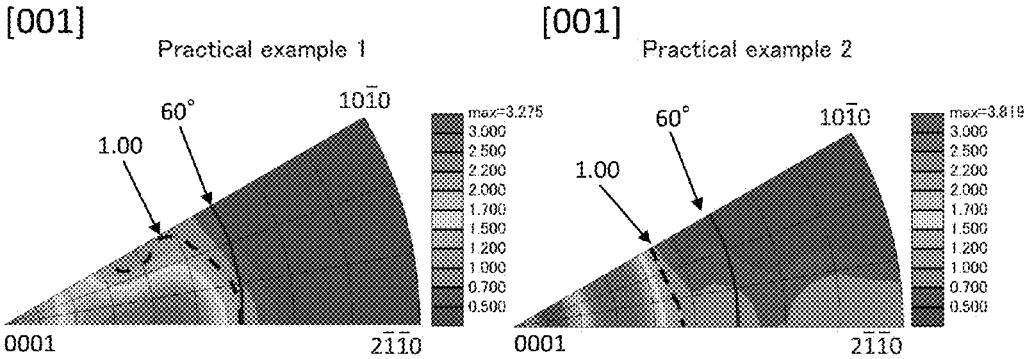
FIG. 2B shows distribution of integration degree of plane orientation (0001) of the hcp crystal with respect to a normal direction (working direction) of a worked surface of practical examples.

FIG. 2B shows distribution of the integration degree (crystal orientation) of plane orientation (0001) of the hcp crystal with respect to a normal line direction (processing direction) of the processed surface. As is understood from FIG. 2B, as characteristics of Practical Examples 1 and 2, a portion in which the integration degree of plane orientation (0001) of the hcp crystal is 1.00 or more exists within a range of 0 to 60 degrees with respect to a normal line of a processed surface. Thus, the material of the present invention has crystals having specific orientation within a specific range of angles in a high frequency.

Figure 3A:
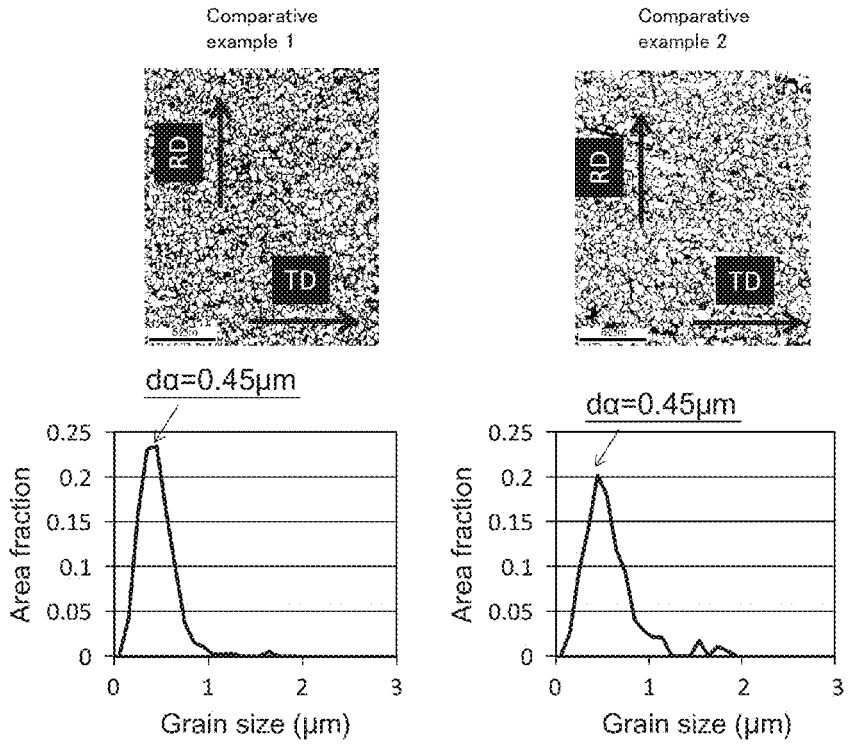
FIG. 3A shows structures of comparative examples and graphs showing crystal grain diameter distributions, which were measured by the electron backscatter diffraction (EBSD) method.
Figure 3B:
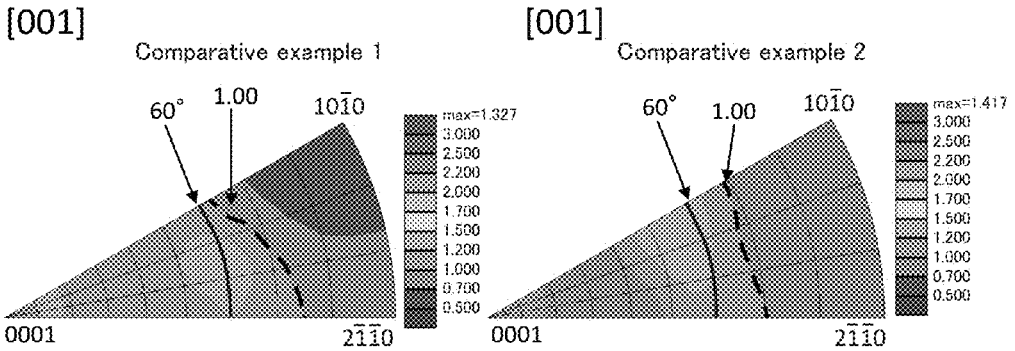
FIG. 3B shows distribution of integration degree of plane orientation (0001) of the hcp crystal with respect to a normal direction (working direction) of a worked surface of comparative examples.

As a comparison, a plate with 4 mm thick Ti-6Al-4V alloy was subjected to solid solution treatment at 1100° C. for 30 minutes, and was quenched by water at a cooling rate of 20° C./sec or more, thereby forming an acicular α' martensite structure. Then, the plate was placed in a furnace and was heated at a temperature increase rate of 100° C./sec. When the temperature of the plate reached 700 to 800° C., the plate was immediately removed from the furnace. The plate was subjected to hot rolling in one pass so that the thickness of the plate was 2.37 mm and the peripheral velocity of the roll was set so that the strain rate at exit from the roll was 10/sec, and was subjected to hot rolling in one pass so that the thickness of the plate was 1.85 mm and the peripheral velocity of the roll was set so that the strain rate at exit from the roll was 1/sec. After the rolling, the plate was cooled at a cooling rate of 5 to 400° C./sec after rolling, thereby obtaining comparative examples. Comparative Example 1 was processed under conditions of a processing temperature of 700° C., a processing strain of 0.77, and a processing strain rate of 1/sec, and Comparative Example 2 was processed in conditions of a processing temperature of 800° C., a processing strain of 0.77, and a processing strain rate of 1/sec. In FIG. 3A, the upper row shows grain boundary maps obtained by the EBSD method, showing structures of the rolled surfaces (processed surfaces) of Comparative Examples 1 and 2, and the lower row shows graphs showing distributions of the crystal diameter of the α phase corresponding to the structures of Comparative Examples 1 and 2. FIG. 3B shows distribution of the integration degree (crystal orientation) of plane orientation (0001) of the hcp crystal with respect to a normal line direction (processing direction) of the processed surface. As is understood from FIGS. 3A and 3B, although equiaxial crystals in which area ratio of crystals having a grain diameter of 1 μm or less is 60% or more, and maximum frequency grain diameter is 0.5 μm or less, was obtained, portions in which the integration degree of plane orientation (0001) of the hcp crystal is 1.00 or more is distributed in a wide range of angles, crystal orientation was low and was nearly random. This is because the introduced strain was low at 0.77, and as mentioned below, the fracture elongation was less than 200% when a tensile test was performed at a tensile test temperature of 650° C. (Comparative Example 1) and 700° C. (Comparative Example 2) and at a tensile strain rate of 0.01/sec.

2. Tensile Test

Figure 4:
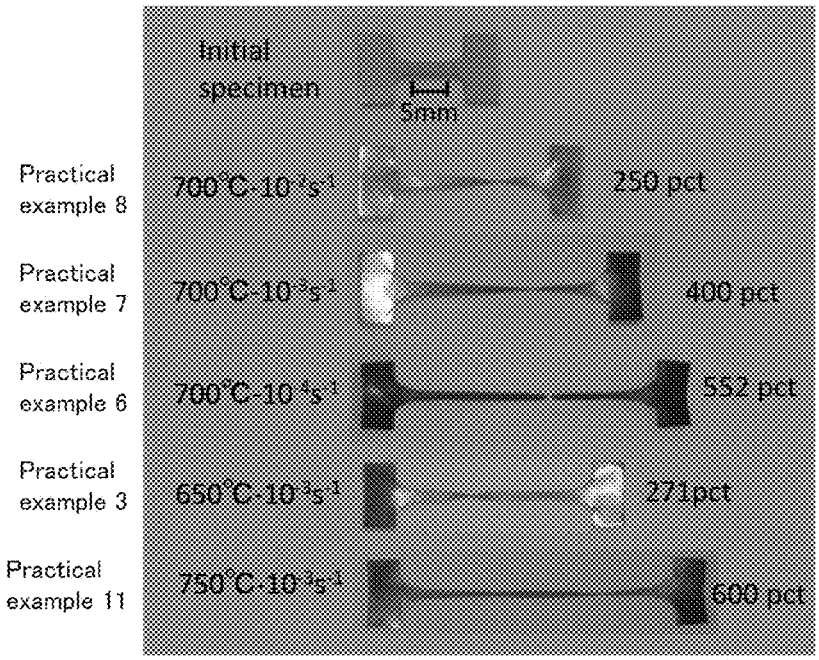
FIG. 4 shows appearances of test pieces and fracture elongation.

Practical examples were produced under the conditions as above, and were formed in a shape shown in FIG. 4 as tensile test pieces (Practical Examples 3 to 13). The tensile test was performed at a predetermined test temperature while changing tensile strain rate from $1\times10^{-4}$ to $1\times10^{-2}$, and exhibition of the superplasticity was evaluated. Tensile test temperature was set at 650° C., 700° C., or 750° C., which are lower than the temperature at which the superplasticity is caused. For example, in conventional Ti-6Al-4V alloys (crystal diameter: 3 to 10 μm, equiaxial crystals α+β structure)), the superplasticity appears at 800 to 950° C., but the tensile test was performed at at least 150° C. lower than this temperature. In the tensile test, when strain rate sensitivity index m of deforming stress is 0.3 or more and fracture elongation (plastic elongation) is 200% or more, it was judged that the superplasticity was caused based on the general difinishon. For comparison, a plate with 4 mm thick Ti-6Al-4V alloy was processed under the same conditions shown in Table 1 through the same process as Comparative Examples 1 and 2, thereby obtaining Comparative Examples 3 to 6.

Appearances of fracture elongations in test pieces after the tensile test are shown in FIG. 4. As shown in FIG. 4, the Ti-6Al-4V alloy plates of the present invention (maximum frequency crystal diameter $d_a$=0.5 μm or more) showed high fracture elongation of 200% or more in all test conditions, and it was confirmed that the superplasticity was caused at a tensile test temperature of 650 to 750° C. and at a tensile strain rate of $1\times10^{-4}$ to $1\times10^{-2}$.

Processing conditions, structure forms, tensile test conditions, and results thereof are shown in Table 1. Area ratio of crystals with diameters of 1 μm or less and maximum frequency crystal diameter were measured by an EBSD method. In Table 1, the case in which a portion in which the integration degree of plane orientation (0001) of the hcp crystal was 1.00 or more exists within a range of 0 to 60 degrees with respect to a normal line of the processed surface was observed is indicated as "Yes" and the case in which the superplasticity was caused is indicated as "Exists". As shown in Table 1, in Practical Examples 3 to 13, the area ratio of crystals having a grain diameter of 1 μm or less was 60% or more, and the maximum frequency crystal diameter was 0.5 μm or less, and a portion in which the integration degree of plane orientation (0001) of the hcp crystal was 1.00 or more exists within a range of 0 to 60 degrees with respect to a normal line of the processed surface, and comprised fine crystal structure. As a result, it may be recognized that the superplasticity was caused at a low temperature of 650 to 750° C. and at a high tensile strain rate of $1\times10^{-4}$ to $1\times10^{-2}$. In contrast, in Comparative Examples 3 and 6, the processing strain was low at less than 1, a portion in which the integration degree of plane orientation was 1.00 or more did not exist within a range of 0 to 60 degrees with respect to a normal line of the processed surface, and maximum frequency crystal diameter was greater than 0.5 μm. In Comparative Examples 4 and 5, the processing strain was low at less than 1, a portion in which the integration degree of plane orientation was 1.00 or more did not exist within a range of 0 to 60 degrees with respect to a normal line of the processed surface, and as a result, the strain rate sensitivity index m of deforming stress was less than 0.3, and the superplasticity was not caused.

degree of plane orientation was 1.00 or more did not exist within a range of 0 to 60 degrees with respect to a normal line of the processed surface, and thus, the superplasticity was not caused.

3. Comparison with the Conventional Material

Figure 6:
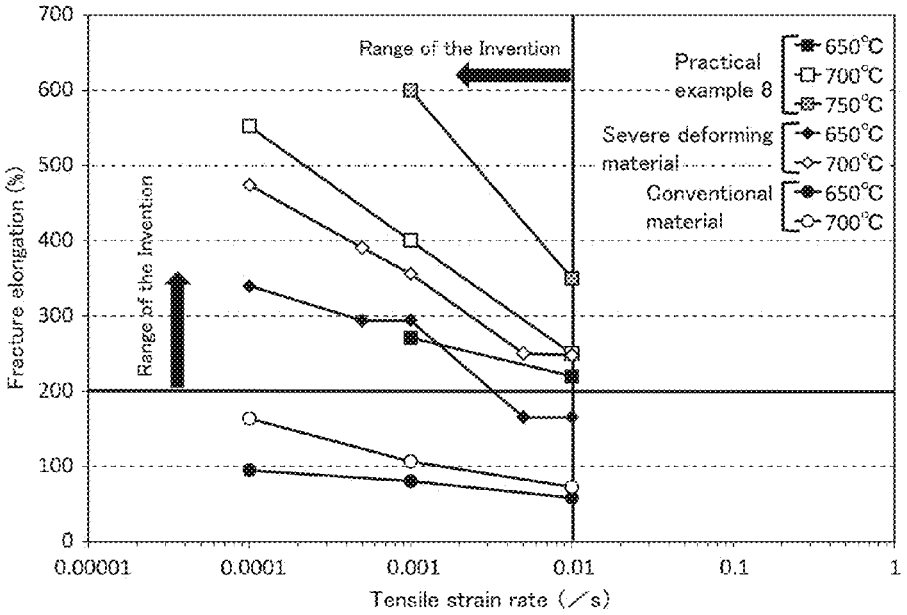
FIG. 6 is a graph showing the relationship between tensile strain rate and fracture elongation in each tensile test temperature.

Fracture elongations of an invented material, a severe deformation material, which is refined by severe deformation process according to "METALLURGICAL AND MATERIALS TRANSACTIONS" (Y. G. K O et al., 2006, 37A, p. 381-391), and a conventional material of Ti-6Al-4V alloy, are compared. The conventional material had an average crystal diameter d of 11 μm and was subjected to anneal at 850° C. for 2 hours. The severe deformation material was produced by the ECAP method with a processing strain of 3.92 and had an average crystal diameter d of 0.3 μm. FIG. 6 is a graph showing the relationship between tensile strain rate ($1\times10^{-4}$ to $1\times10^{-2}$) of the invented materials (Practical Examples 3, 4, 6 to 8, 11, and 12) which were obtained by hot working performed at a temperature of 750 to 850° C. at a processing strain of 1.05 and fracture elongation. As shown in FIG. 6, in the invented materials, the fracture elongation was greatly improved compared to the conventional material in tensile strain rate ($1\times10^{-4}$ to $1\times10^{-2}$) at the tensile test temperatures. Further-

TABLE 1

| | Condition of processing starting material | | | Area ratio (Particle diameter | Maximum frequency | Integration degree (1 or more | Condition of tensile test | | Fracture | Strain rate sensi- | Presence of |
|---|---|---|---|---|---|---|---|---|---|---|---|
| | Processing temperature (° C.) | Processing strain | Processing strain rate (/sec) | is 1 μm or less) (%) | particle diameter (μm) | exists within a range of 0 to 60 degrees) | Temperature (° C.) | Strain rate (/sec) | elon-gation (%) | tivity index m | super - plasticity phenomenon |
| Comparative Example 3 | 750 | 0.52 | 10 | 84 | 0.75 | No | 650 | 0.01 | 130 | 0.15 | None |
| Comparative Example 4 | 700 | 0.77 | 1 | 99 | 0.45 | No | 650 | 0.01 | 170 | 0.15 | None |
| Practical Example 3 | 800 | 1.05 | 10 | 68 | 0.49 | Yes | 650 | 0.001 | 271 | 0.31 | Exists |
| Practical Example 4 | 800 | 1.05 | 22 | 66 | 0.45 | Yes | 650 | 0.01 | 220 | 0.31 | Exists |
| Practical Example 5 | 800 | 1.55 | 22 | 78 | 0.40 | Yes | 650 | 0.01 | 250 | 0.31 | Exists |
| Comparative Example 5 | 800 | 0.77 | 1 | 92 | 0.45 | No | 700 | 0.01 | 180 | 0.18 | None |
| Practical Example 6 | 800 | 1.05 | 7 | 71 | 0.49 | Yes | 700 | 0.0001 | 552 | 0.37 | Exists |
| Practical Example 7 | 750 | 1.05 | 10 | 73 | 0.45 | Yes | 700 | 0.001 | 400 | 0.37 | Exists |
| Practical Example 8 | 750 | 1.05 | 22 | 74 | 0.43 | Yes | 700 | 0.01 | 250 | 0.37 | Exists |
| Practical Example 9 | 800 | 1.55 | 39 | 68 | 0.49 | Yes | 700 | 0.01 | 280 | 0.37 | Exists |
| Practical Example 10 | 800 | 1.24 | 10 | 69 | 0.49 | Yes | 700 | 0.01 | 270 | 0.37 | Exists |
| Practical Example 11 | 850 | 1.05 | 10 | 69 | 0.48 | Yes | 750 | 0.001 | 600 | 0.50 | Exists |
| Comparative Example 6 | 800 | 0.52 | 10 | 81 | 0.70 | No | 750 | 0.01 | 160 | 0.21 | None |
| Practical Example 12 | 700 | 1.05 | 7 | 70 | 0.38 | Yes | 750 | 0.01 | 350 | 0.50 | Exists |
| Practical Example 13 | 850 | 1.55 | 10 | 64 | 0.48 | Yes | 750 | 0.01 | 410 | 0.50 | Exists |

Figure 5:
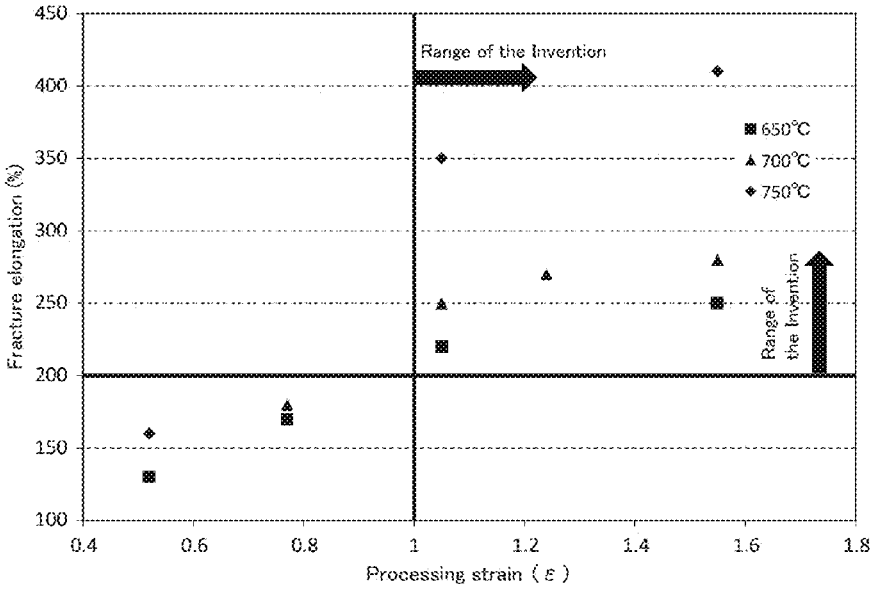
FIG. 5 is a graph showing the relationship between hot working strain (c) introduced in working of the practical example and fracture elongation in a tensile test in which tensile strain rate was $1\times10^{-2}$/sec.

FIG. 5 shows a relationship between processing strain introduced by hot working at a temperature of 750 to 850° C. for obtaining practical examples and fracture elongation in the tensile test at a tensile strain rate of $1\times10^{-2}$/sec of the practical examples obtained by the tensile test. As shown in FIG. 5, if the processing strain was less than 1, the fracture elongation was less than 200% due to difference of the structural form and that a portion in which the integration more, the invented materials had fracture elongation equal to or greater than that of the severe deformation materials at each tensile test temperature at each tensile strain rate. Specifically, the fracture elongation of the severe deformation material at a tensile test temperature of 650° C. in a strain rate of $1\times10^{-2}$ was less than 200%, but the fracture elongation of the invented material was good at more than 200%.

Table 2 shows strain rate sensitivity indexes m of invented materials (Practical Examples 4, 8, and 12), the severe deformation material according to "METALLURGICAL AND MATERIALS TRANSACTIONS", and the conventional material at each plastic deformation temperature (tensile test temperature) in a strain rate of $1\times10^{-2}$. In general, value m in ordinary plastic deformation is about 0.1 to 0.2 or more, but m is large within $1>m\geq0.3$ in a region of the superplasticity. The materials of the present invention showed higher values m than the severe deforming material and the conventional material, and exceeded 0.3, and showed superior superplasticity characteristics.

TABLE 2

| Plastic deformation temperature (Tensile test temperature) (° C.) | Strain rate sensitivity index m | | |
|---|---|---|---|
| | Invented material | Severe deformation material | Conventional material |
| 650 | 0.31 | 0.24 | 0.10 |
| 700 | 0.37 | 0.28 | 0.11 |
| 750 | 0.50 | — | — |

Figure 7A:
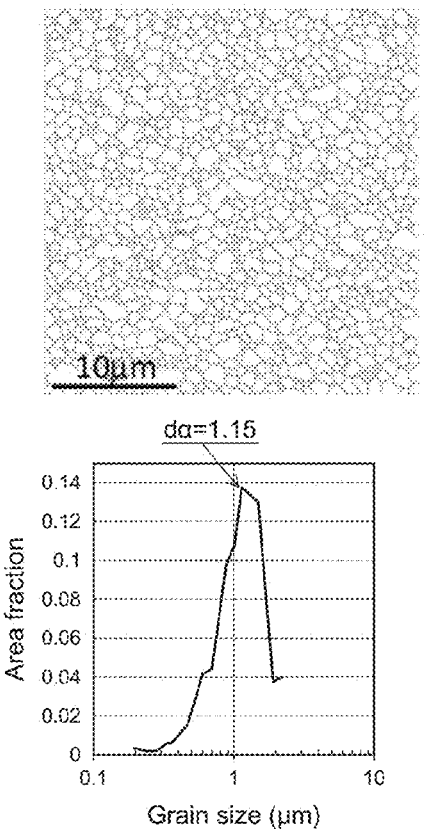
FIG. 7A shows structures of practical examples of the present invention and graphs showing crystal grain diameter distributions, which were measured by the electron backscatter diffraction (EBSD) method.
Figure 7B:
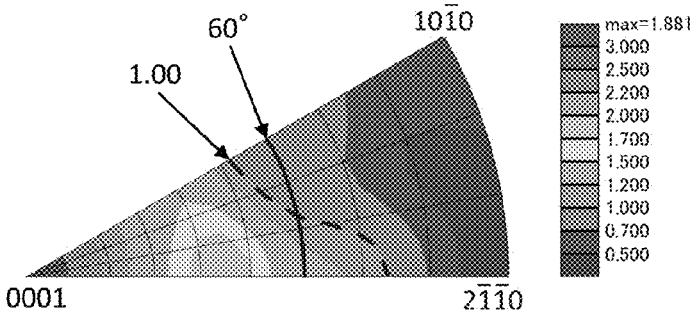

FIG. 7A shows a structural form of the invented material after a tensile test performed at a temperature of 700° C. at a strain rate of $1\times10^{-2}$. It should be noted that the material of the present invention was produced by the same process as for Practical Examples 1 to 13, and the temperature increase rate in hot rolling was 12° C./sec and the hot rolling was performed in one pass such that the thickness of the material was 1.4 mm when the material temperature was 700° C. The rolling was performed setting the peripheral velocity of the roll such that the strain rate at exit of the roll was 7/sec. The cooling rate after rolling was 100° C./sec. In FIG. 7A, the upper row shows grain boundary maps obtained by the EBSD method, showing structures of the rolled surfaces (processed surfaces) of the invented material, and the lower row shows graphs showing distributions of the crystal diameter of the α phase. FIG. 7B shows distribution of the integration degree (crystal orientation) of plane orientation (0001) of the hcp crystal with respect to a normal line direction (processing direction) of the processed surface. As shown in FIG. 7A, the invented material had a uniform and fine equiaxial structure having crystal grain diameter was about 1 μm after the tensile test. Although the maximum frequency crystal diameter was 1.15 μm and crystal orientation was degraded according to FIG. 7B compared to the invented material before the tensile test, it may be understood that high strength was maintained before deformation since uniform equiaxial crystals with a diameter of about 1 μm were formed.

Thus, according to the present invention, a Ti-6Al-4V alloy plate composed of approximately a single α phase, and comprising a fine equiaxial crystals structure in which area ratio of crystals having a grain diameter of 1 μm or less is 60% or more, and maximum frequency grain diameter is 0.5 μm or less, wherein a portion in which the integration degree of plane orientation (0001) of the hcp crystal is 1.00 or more exists within a range of 0 to 60 degrees with respect to a normal line of a processed surface of the alloy can be obtained by performing plastic working in suitably controlling the processing temperature and processing rate using an α' martensite structure as a starting structure. In the processing, an ultrafine structure can be obtained only by processing strain of 1 or more (for example, a 4 mm thick plate is worked to 1.4 mm thick or less by rolling). The reason for this may be said to be that non-contiguous dynamic recrystallization, which hardly acts conventionally, actively acts by hot working at a high strain rate using an α' martensite as a starting structure. Therefore, the processing can be more practically performed compared to a severe deforming process, and production cost can be restricted to the same amount as the cost for production of existing Ti alloy plates. Therefore, Ti-6Al-4V alloy plates having ultrafine crystal grains causing superplasticity at low temperatures and high rates of deformation can be produced by a simple production method using existing machinery.

In the present invention, since crystal grains are refined by hot working under suitable processing conditions using an α' structure of a Ti alloy as a starting structure, the method can be applied not only to Ti-6Al-4V alloys, but also other α+β type alloys, and superplasticity at low temperatures with high deformation rate in other α+β type alloys. For example, as other α+β type alloys, Ti-8Mn, Ti-3Al-2.5V, Ti-6Al-6V-2Sn, Ti-7Al-1Mo, Ti-6Al-2Sn-4Zr-6Mo, Ti-5Al-2Cr-1Fe, and Ti-6Al-2Sn-4Zr-2Mo may be mentioned.

The present invention can be applied to all products of Ti alloys which are subjected to superplastic forming and to all Ti alloy members which are subjected to superplastic blow molding or diffusion bonding (SPF/DB). For example, the present invention can be applied to Ti alloy members for aircraft (refer to "JOM" L. D. HefTi, 2010, 62-5, pp. 42-45). Furthermore, the present invention can be applied to members that are subjected to superplastic forming, such as chemical plants, energy production plants, general consumer products, and sporting goods. Furthermore, since the α+β type Ti alloys of the present invention cause superplasticity at low temperatures (650° C. or more) with a high strain rate of $10^{-2}$/sec, which is identical to the industrial production rate, and high strength and fine crystal structure can be obtained after superplastic deformation, the invention can be used in primary processing to produce plates, rods, and wires.

The invention claimed is:

1. An α+β titanium alloy comprising:

an ultrafine structure consisting of equiaxial crystals in which area ratio of crystals having a grain diameter of 1 μm or less is 60% or more, and a maximum frequency grain diameter is 0.5 μm or less;

wherein a portion in which an integration degree of plane orientation (0001) of a hexagonal close-packed crystal is 1.00 or more exists within a range of 0 to 60 degrees with respect to a normal line of a processed surface of the alloy.

2. The α+β titanium alloy according to claim 1, wherein the alloy exhibits superplasticity phenomenon when the alloy is deformed at a temperature of 650 to 950° C. with a tensile strain ratio of $1\times10^{-4}$ to $10^{-2}$/sec.

3. The α+β titanium alloy according to claim 1, wherein the alloy consists of 4 to 9 mass % of Al, 2 to 10 mass % of V, and a balance of Ti and inevitable impurities.

4. The α+β titanium alloy according to claim 3, wherein the alloy is a Ti-6Al-4V.

5. A production method for an α+β titanium alloy according to claim 1, the method comprising:

heating a material at a temperature of 1000° C. or more and maintaining for 1 second or more, cooling the material to room temperature at a cooling rate of 20° C./sec or more, heating the material to a temperature of 700 to 850° C. at a temperature increase rate of 3.5 to 800° C./sec and maintaining for less than 10 minutes, hot working the material at a strain rate of 1 to 50/sec with a strain of 1 or more; and cooling the material at a cooling rate of 5 to 400° C./sec.

6. The α+β titanium alloy according to claim 1, wherein the alloy has 200% or more of fracture elongation.

7. The α+β titanium alloy according to claim 6, wherein the alloy exhibits superplasticity phenomenon when the alloy is deformed at a temperature of 650 to 750° C. with a tensile strain ratio of $1\times10^{-4}$ to $10^{-2}$/sec.

* * * * *